US007138948B2

(12) United States Patent
Yeh

(10) Patent No.: US 7,138,948 B2
(45) Date of Patent: Nov. 21, 2006

(54) ANTENNA ARRAY OF PRINTED CIRCUIT BOARD

(75) Inventor: Ming-Hao Yeh, Hsinchu (TW)

(73) Assignee: Alpha Networks Inc., Hsinchu (TW)

( * ) Notice: Subject to any disclaimer, the term of this patent is extended or adjusted under 35 U.S.C. 154(b) by 22 days.

(21) Appl. No.: 10/991,413

(22) Filed: Nov. 19, 2004

(65) Prior Publication Data

US 2006/0109175 A1 May 25, 2006

(51) Int. Cl.
*H01Q 1/38* (2006.01)
*H01Q 1/36* (2006.01)

(52) U.S. Cl. ..... 343/700 MS; 343/702; 343/895; 343/846

(58) Field of Classification Search ..... 343/700 MS, 343/895, 853, 893
See application file for complete search history.

(56) References Cited

U.S. PATENT DOCUMENTS 6,337,666 B1 * 1/2002 Bishop ..... 343/795
2005/0248487 A1 * 11/2005 Okado ..... 343/700 MS

* cited by examiner

*Primary Examiner*—Trinh Vo Dinh
(74) *Attorney, Agent, or Firm*—Bacon & Thomas, PLLC

(57) ABSTRACT

The present invention discloses an antenna array installed on a printed circuit board, which comprises two antenna units, each being a microstrip directly installed on two symmetric ends of a T-shape microstrip on a printed circuit board and an asymmetric end of the T-shape microstrip circuit being a feeding end feeding signals simultaneously to the two antenna units. A grounding metal surface is fabricated on the other side of the printed circuit board at a position other than the antenna unit, and keeps a specific distance from at least one corresponding edge of the antenna unit. Since the antenna units are symmetric in shape and have the same feeding end, the radiation direction thereof is shifted towards the two symmetric edges to broaden the range of the use of two symmetric edges.

5 Claims, 10 Drawing Sheets

ANTENNA ARRAY OF PRINTED CIRCUIT BOARD

FIELD OF THE INVENTION

The present invention relates to an antenna, more particularly to an antenna array installed on a printed circuit board and comprising two antenna symmetric in shape and fed with signals via the same feeding end. Therefore, the radiation direction of the antenna array may be shifted towards the two symmetric edges to broaden the range of the use of two symmetric edges.

BACKGROUND OF THE INVENTION

In recent years, the market demand for mobile communications products increases drastically, and thus wireless communications are developed more quickly. Manufacturers tend to design the wireless network cards, particularly the mini wireless card designed for the USB interface smaller and smaller. Therefore, the space reserved for installing an antenna in such wireless network card also becomes smaller. Further, the internal components of the wireless network card also occupy certain spaces. These factors definitely will restrict the position for installing the antenna in a design for wireless network cards. Since the present wireless local area network (WLAN) specification requires an antenna diversity function for the wireless network cards to prevent any dead spot while using a wireless network card, therefore when a manufacturer designs a general wireless network card, at least two antennas are installed inside the wireless network card. The wireless network card designed for the USB interface is no exception either. Since the size of such wireless network card for the USB interface is getting smaller and smaller in these years, the distance between any two antennas installed in the wireless network card with the USB interface is becoming closer and closer and thus causing an interference of signals between these two antennas and an isolation problem between the antennas.

In view of the foregoing issues, many manufacturers at present adopt a single chip antenna for the design of a wireless network card with the USB interface. The chip antenna is generally made by a low temperature cofired ceramic (LTCC) technology, and features a very small volume and thus can provide a flexible use of the space. However, in the actual practice, it is not exactly so. In general, the installation position of such chip antenna usually cannot be designed according to the best conditions recommended by the numeric analysis, but it requires additional components such as capacitors and inductors that will occupy more spaces unnecessarily. Furthermore, such chip antenna also has the following drawbacks:

1. Since the dielectric constant of the material of the chip antenna is very large, therefore the bandwidth will be insufficient, and thus causing a lower performance to the antenna.

2. Additional material cost and installation procedure are incurred for making such chip antenna.

3. Please refer to FIGS. 1 and 2. Due to the relation between the designed installation position of this type of chip antenna 11, 21 on a wireless network card 10, 20 and the grounding metal surface 12, 22 on its right side produces an isolation effect on the grounding metal surface 12, 22, so that the radiating direction of the antenna shifts to the left. The radiation pattern requires a stronger directionality which will cause dead spots to the use of the wireless network card.

Further, the traditional antenna arrays 30, 40 as shown in FIGS. 3 and 4 comprise four antenna units 31, 41 each. In the basic designed structure of such antenna arrays 30, 40, each antenna unit 31, 41 uses the same phase to feed signals, and each antenna unit 31, 42 has the same shape, size and installed direction, and the distance between every two antenna units is the same, such that the electric current distribution and phase for each antenna unit 31, 41 can be kept equal, and thus effectively enhancing the antenna gain. In other words, the directionality at the free end (or front end) of the antenna unit 31, 41 can be improved effectively.

However, the actual design of an antenna array 30, 40 usually needs to satisfy certain design specifications and application requirements, and it is necessary to vary the quantity, installing position as well as the phase and intensity of the input current, particularly for a wireless network card with a USB interface installed on a mini printed circuit board. Due to the limitations on space and mechanical design, the basic architecture and design concept for the foregoing antenna cannot be applied successfully to such mini printed circuit board from beginning to end, and the directionality for both left and right sides cannot be improved effectively.

Therefore, the present invention designs an ideal antenna array to provide a larger coverage on the use of the wireless network card with a low cost under the conditions of limited space and mechanical restrictions of the mini printed circuit board.

SUMMARY OF THE INVENTION

In view of the aforementioned shortcomings of the traditional chip antennas and antenna arrays that cannot meet the design requirements of the mini printed circuit, the inventor based on years of experience and professional knowledge on antenna design and manufacture to extensively conduct researches and experiments for the improvement and find a solution, and finally developed an antenna array of a printed circuit board in accordance with the present invention.

A primary objective of the present invention is to provide an antenna array which comprises two antenna units, each being a microstrip directly installed on two symmetric ends of a T-shape microstrip on a printed circuit board; and one asymmetric end of the T-shape microstrip circuit being a feeding end of the antenna array, such that the feeding end feeds signals simultaneously to the two antenna units. A grounding metal surface is printed on another side of the printed circuit board at a position other than the antenna unit, and the grounding metal surface keeps a specific distance from at least one corresponding edge of the antenna unit. Since the feeding method and design position of the antenna unit are symmetric in shape and the same feeding end feeds signals, therefore each antenna unit not only inputs currents of the same phase, and the current distribution and radiation pattern also produce a symmetric effect, and the radiation direction is shifted towards the two symmetric edges without centralizing at the central position as to broaden the range of the use of two symmetric edges.

Another objective of the present invention is to install an antenna unit on the printed circuit board adjacent to two corners in a meandering symmetrical manner as to provide a sufficient equivalent length.

A further objective of the present invention is to extend a broadband plane on at least one external edge of the antenna unit to increase the bandwidth, so that a designer can make use of the distance between the broadband plane and the grounding metal surface to fine tune the resonant frequent position of the antenna unit easily.

The above and other objects, features and advantages of the present invention will become apparent from the following detailed description taken in conjunction with the accompanying drawings.

DETAILED DESCRIPTION OF THE PREFERRED EMBODIMENTS

Figure 1:
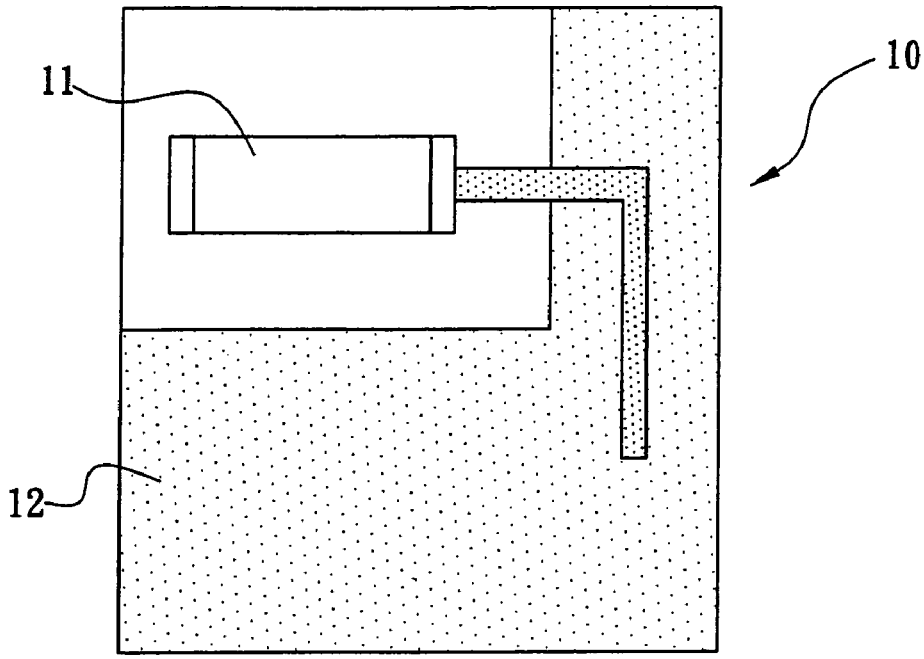
FIG. 1 is an illustrative planar view of a traditional chip antenna being installed to a wireless network card.
Figure 2:
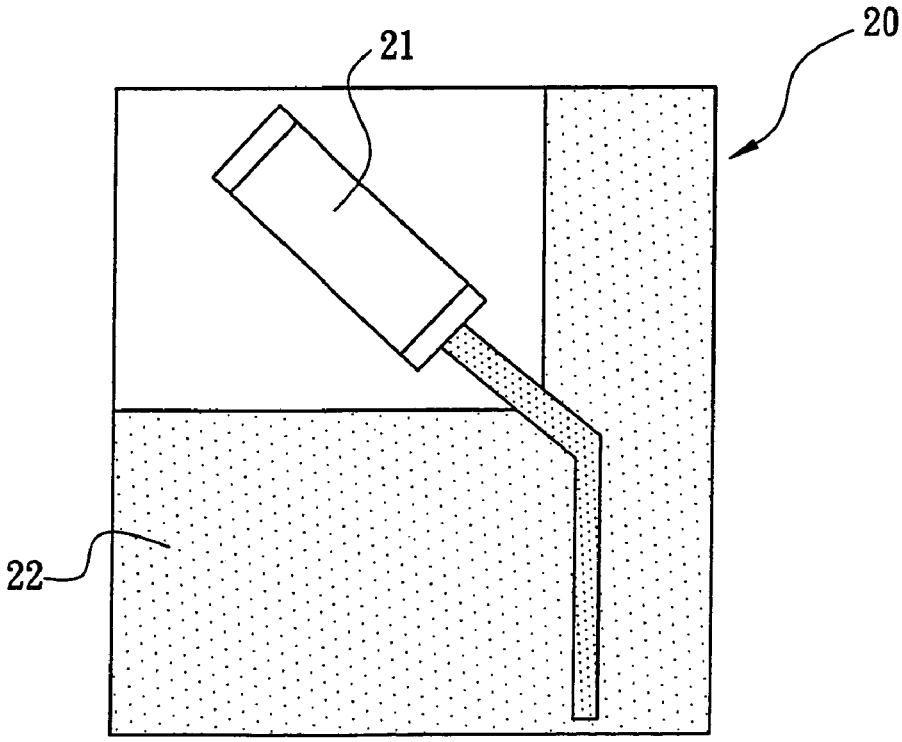
FIG. 2 is an illustrative planar view of another traditional chip antenna being installed to another wireless network card.
Figure 3:
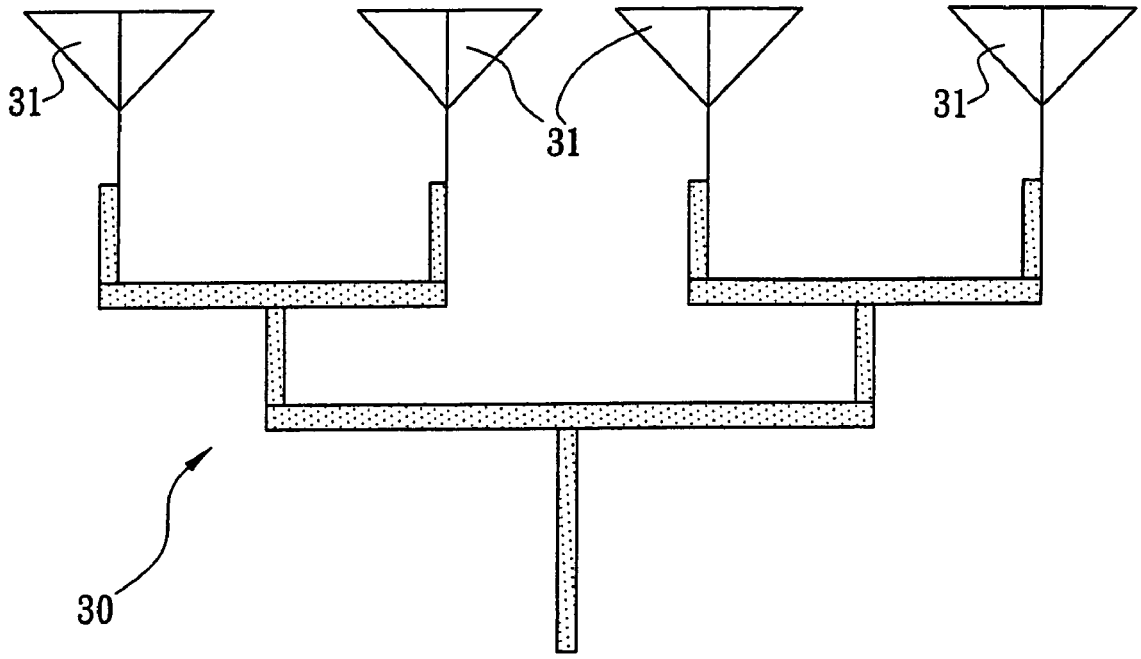
FIG. 3 is an illustrative view of a traditional antenna array structure.
Figure 4:
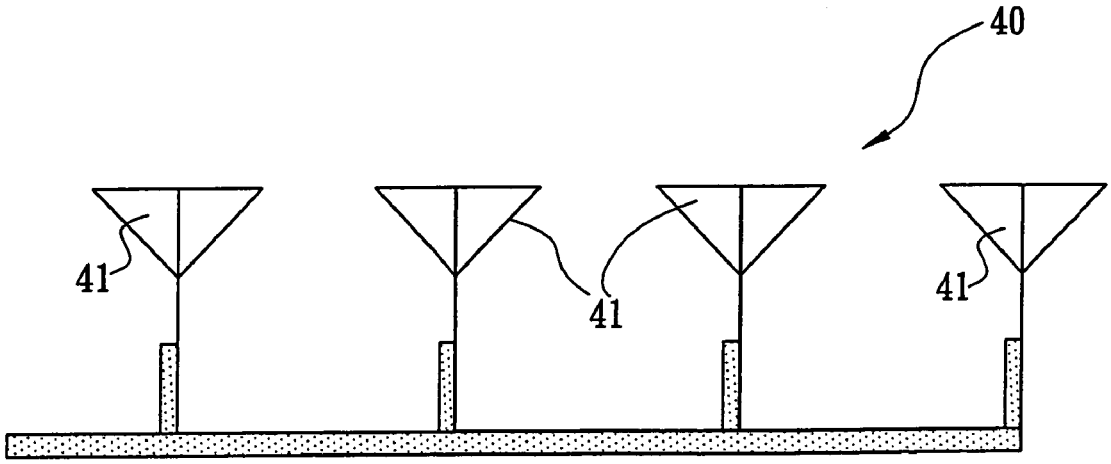
FIG. 4 is another illustrative view of a traditional antenna array structure.
Figure 5:
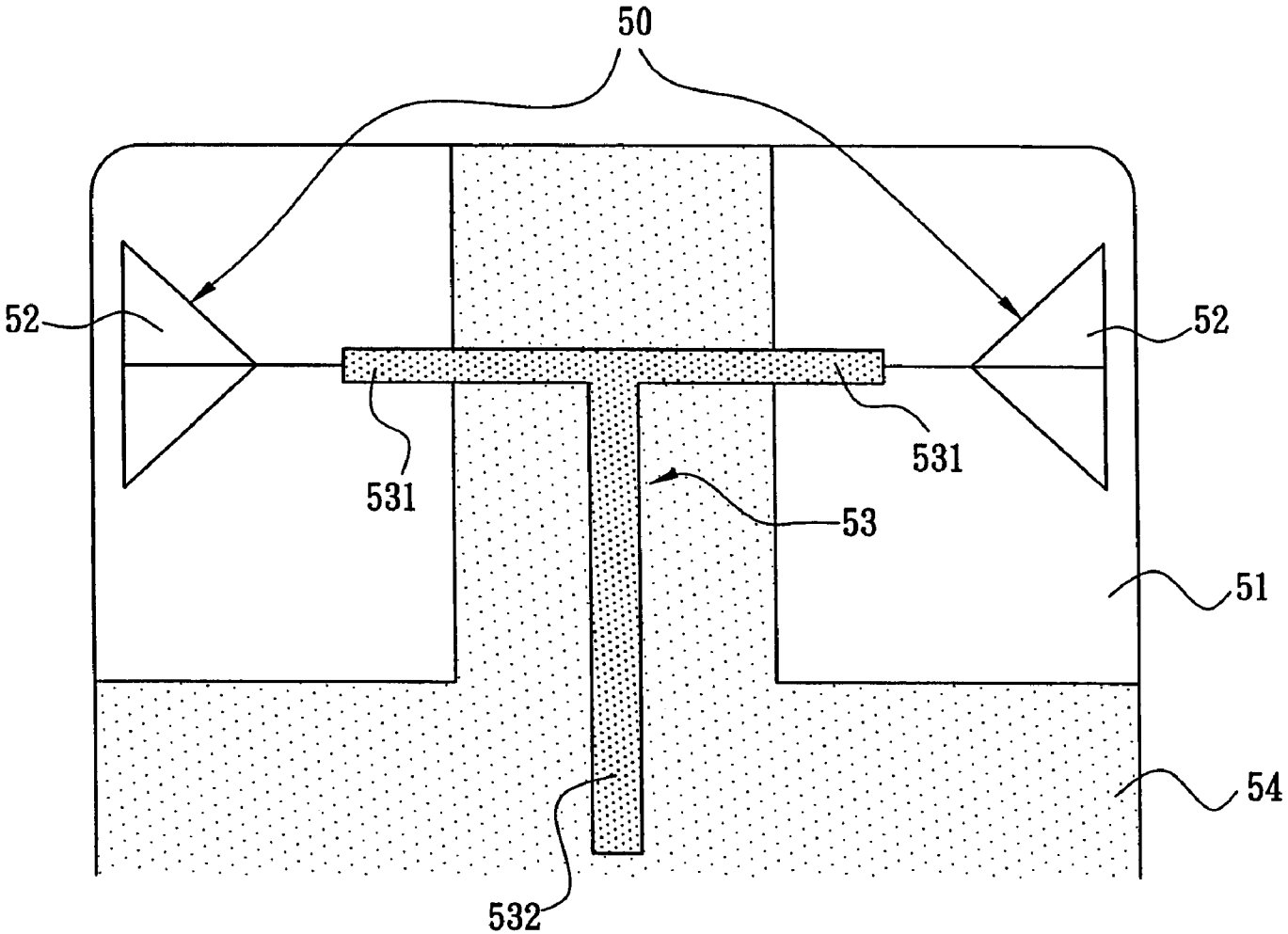
FIG. 5 is an illustrative view of another traditional antenna array structure.

Please refer to FIG. 5 for an antenna array 50 of a printed circuit board 51. When the antenna array 50 is fabricated on a mini printed circuit board 51 of a wireless network card with a USB, the manufacturing technology for printed circuit boards 51 uses a microstrip mode to install the antenna array 50 onto one side of the printed circuit board 51. The antenna array 50 comprises two antenna units 50, and one end proximate to the antenna unit 52 is coupled separately to two symmetric ends 531 of a T-shape microstrip circuit 53 on a printed circuit board 51, and the asymmetric end 532 on the T-shape microstrip circuit 53 is coupled to a transmit circuit (not shown in the figure) on the wireless network card with a USB interface and acts as a feeding end of the antenna array 50, so that the transmit circuit on the wireless network card with a USB interface can feed signals to the two antenna units 52 through the feeding end. A grounding metal surface 54 is fabricated on the other side of the printed circuit board 51 at a position other than that corresponding to the antenna units 52 and the grounding metal surface 54 keeps a specific distance from at least one corresponding edge of each of the antenna units 52. Since the feeding method and designed position of each antenna unit 52 according to the present invention are symmetric in shape and use the same feeding end to feed signals, therefore each antenna unit 52 not only feeds current in the same phase, but also produces a symmetric effect to the current distribution and radiation pattern. As a result the radiating direction shifts to both symmetric sides instead of concentrating on the central position, and the invention increases the range of the use at both symmetric sides. In addition, since the antenna array 50 is fabricated on the printed circuit board 51, the technology of manufacturing printed circuit boards is used directly to install the antenna array 50 on the printed circuit board without requiring an additional antenna, and thus lowering the manufacturing cost and simplifying the installation procedure.

Figure 6:
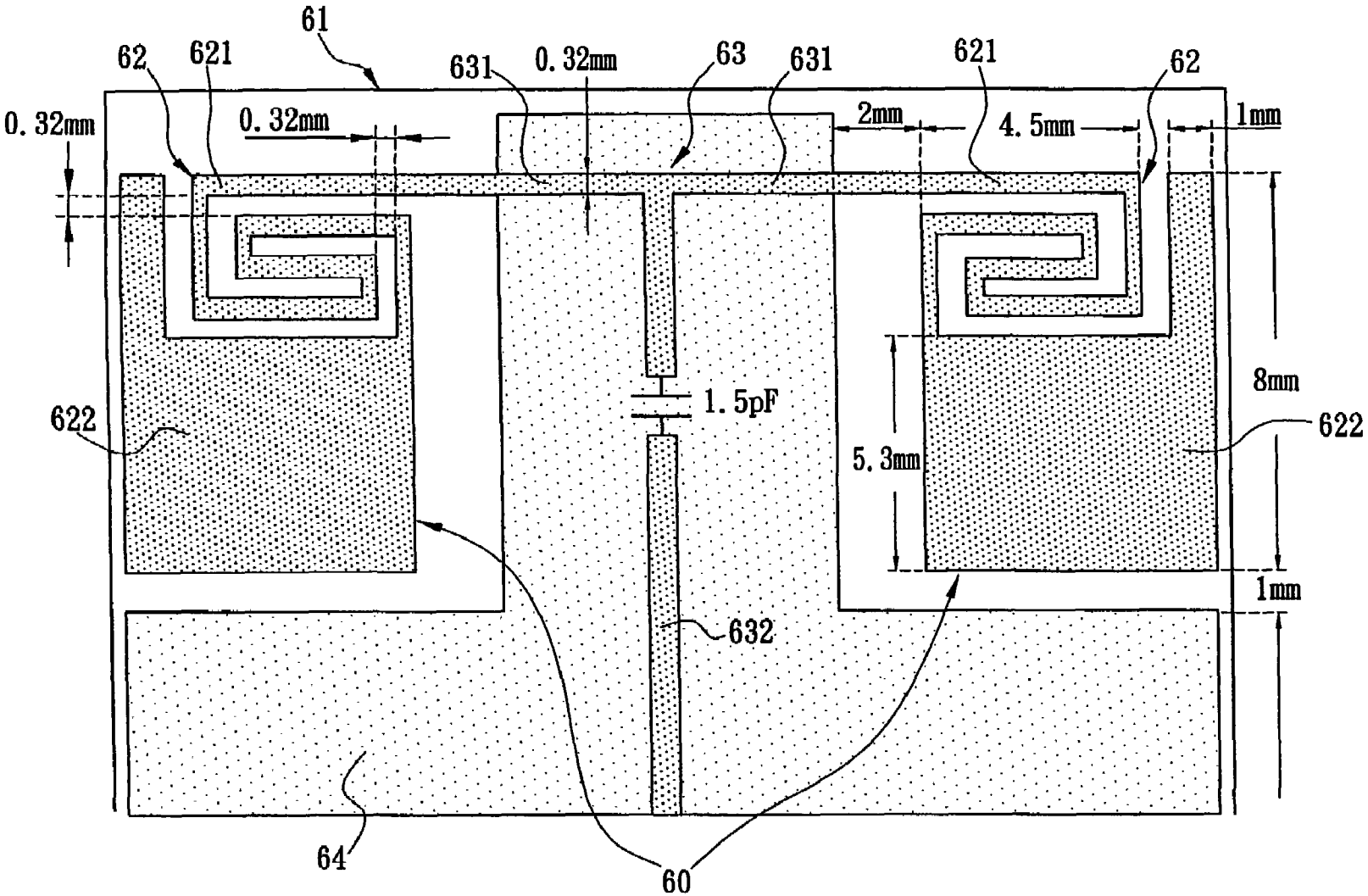
FIG. 6 is an illustrative view of designing a circuit of the wireless network card with a USB interface onto the traditional antenna array structure as depicted in FIG. 5.

Please refer to FIG. 6 for a preferred embodiment of the present invention, which installs an antenna array on one side of the mini printed circuit board 61 of a wireless network card with a USB interface, and uses the technology of fabricating printed circuit boards 61 to produce the required antenna array by the microstrip mode. The antenna array comprises two antenna units 62, and the antenna unit 62 is meandering in shape and symmetrically disposed on two corners proximate to the top of the printed circuit board 61. The designed position should assure the two antenna units 62 to be able to produce a resonance within the operating frequency range of the wireless network while giving consideration to the use for both left and right directions of the wireless network card.

Figure 7:
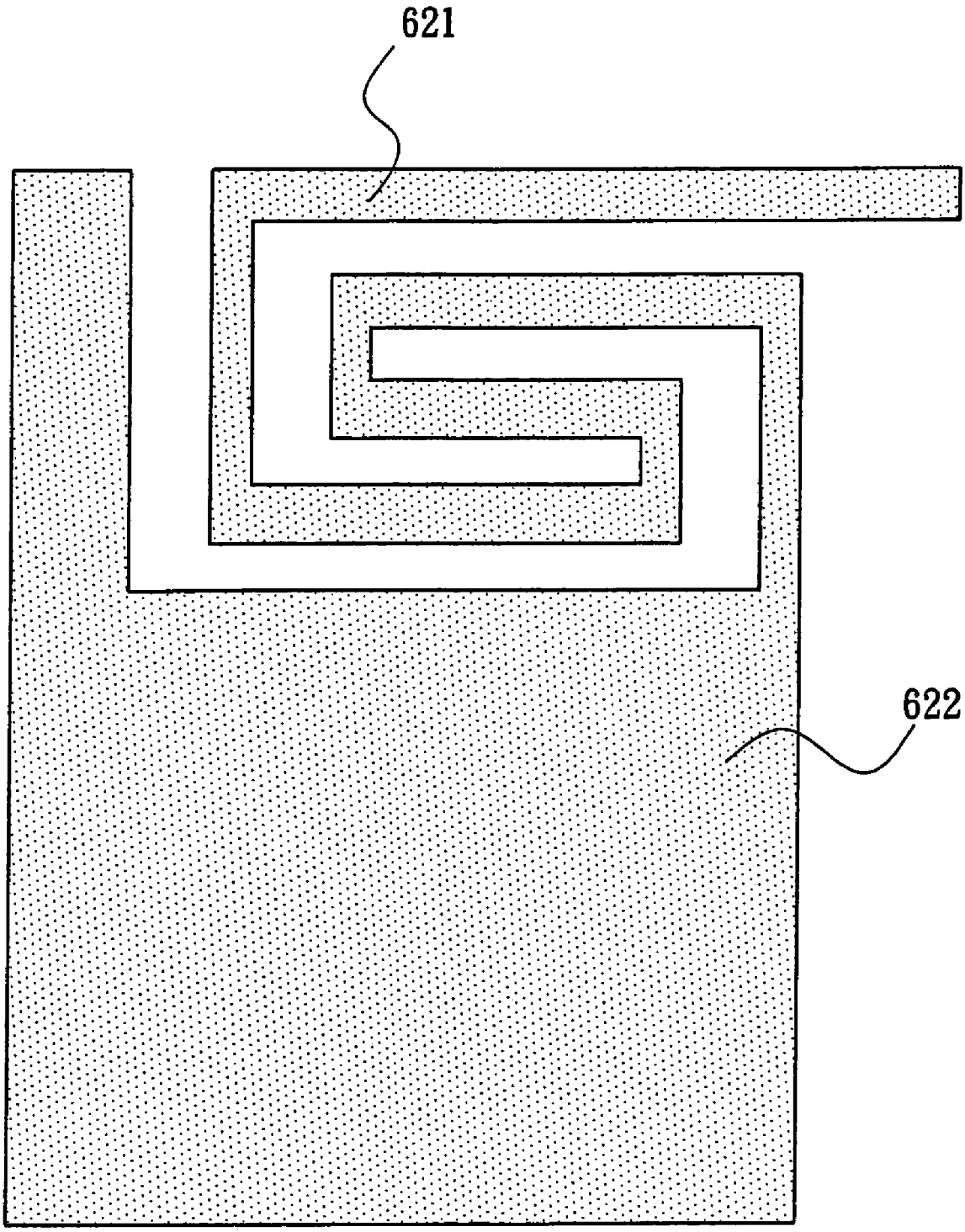
FIG. 7 is an illustrative view of a signal antenna unit structure as depicted in FIG. 6.

In the embodiment, one end proximate to the two antenna units 61 is coupled individually to two symmetric ends 631 of a T-shape microstrip circuit 63 on the printed circuit board 61, and an asymmetric end 632 on the I-shape microstrip circuit 63 is coupled to a transmit circuit (not shown in the figure) on the wireless network card with the USB interface. Please refer to FIG. 7 for the shape and structure of the antenna unit 62. Due to the limited space and structure restriction, the present invention provides a sufficient equivalent length for the antenna array and uses the coil winding technology to produce the required meandering microstrip 621 on two symmetric corners proximate to the top of the printed circuit board 61. To improve the bandwidth of each antenna unit 62, a meandering microstrip 621 disposed on at least one external edge is extended to an extended area planar section (hereinafter referred to as "a broadband plane") 622, so that the antenna array designer can easily fine tune the resonant frequency position of each antenna unit 62 by adjusting the distance between the broadband plane 622 and the grounding metal surface 64. As shown in FIG. 6, the broadband plane 622 extends from the other end of the meandering microstrip 621 in at least one direction to a position adjacent to the corresponding edge of grounding metal surface 64 or edge of said printed circuit board 61.

Please refer to FIG. 6 for a preferred embodiment of the invention. An asymmetric end 632 on the T-shape microstrip 63 is coupled to a transmit circuit on the wireless network card with a USB interface as the feeding end of the antenna array, while feeding signals to the two antenna units 62, and thus the aforementioned isolation issue will not occur and the input impedance of the antenna array is adjusted to 50 ohms by connecting a 1.5 pF capacitor in series. Further, please refer to FIG. 6. Since the feeding method and design position of the two antenna units 62 according to the preferred embodiment are symmetric and feed signals through the same feeding end, therefore each antenna unit 62 not only feeds current of the same phase, its current distribution and radiation pattern also produce a symmetric effect, so that the radiating direction shifts toward both symmetric edges without concentrating at the central position and thus effectively broadening the range of the use at the two symmetric edges.

Figure 8:
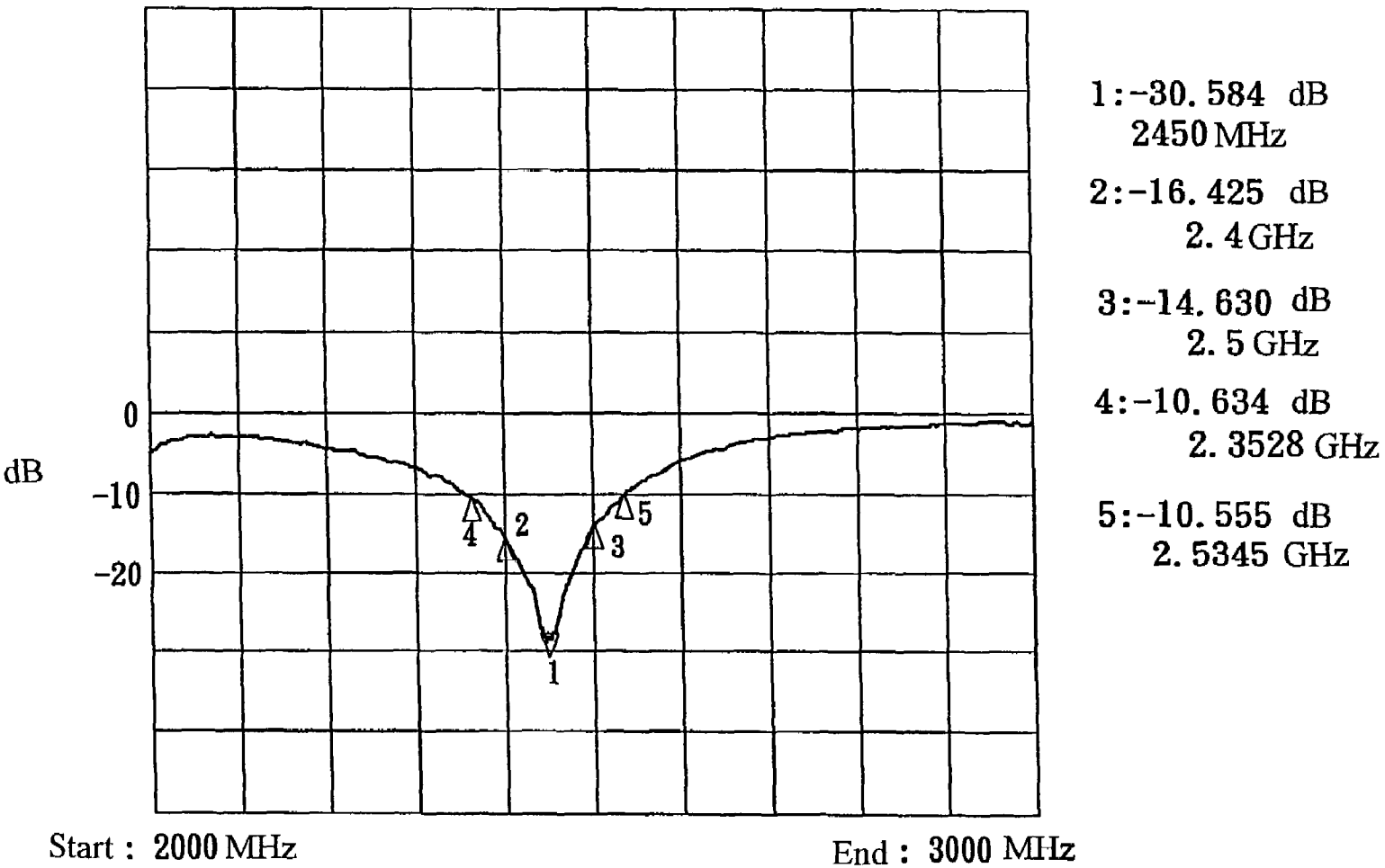
FIG. 8 is graph of the actual measured result of the antenna array provided by the signal antenna unit structure as depicted in FIG. 6.
Figure 9:
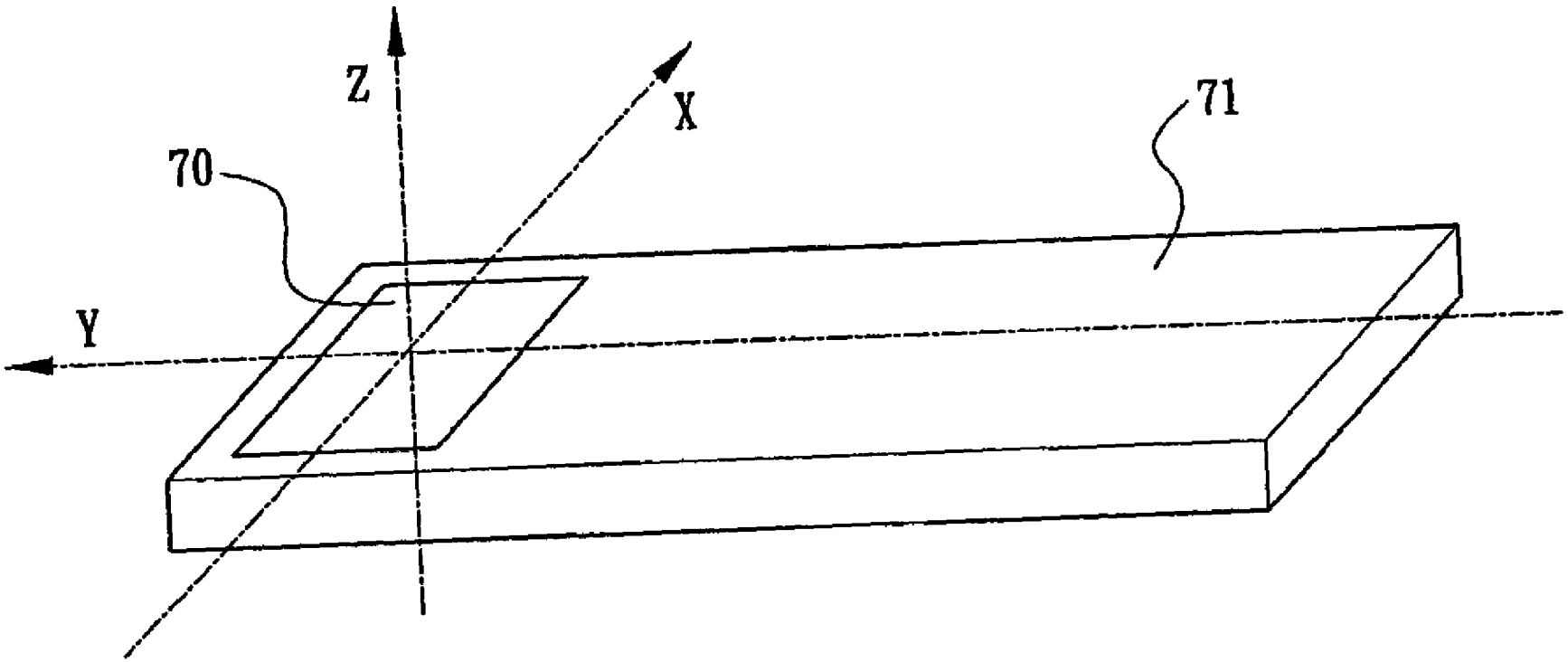
FIG. 9 is an illustrative view of the planar coordinates of an antenna array being designed on the wireless network card with a USB interface.
Figure 10:
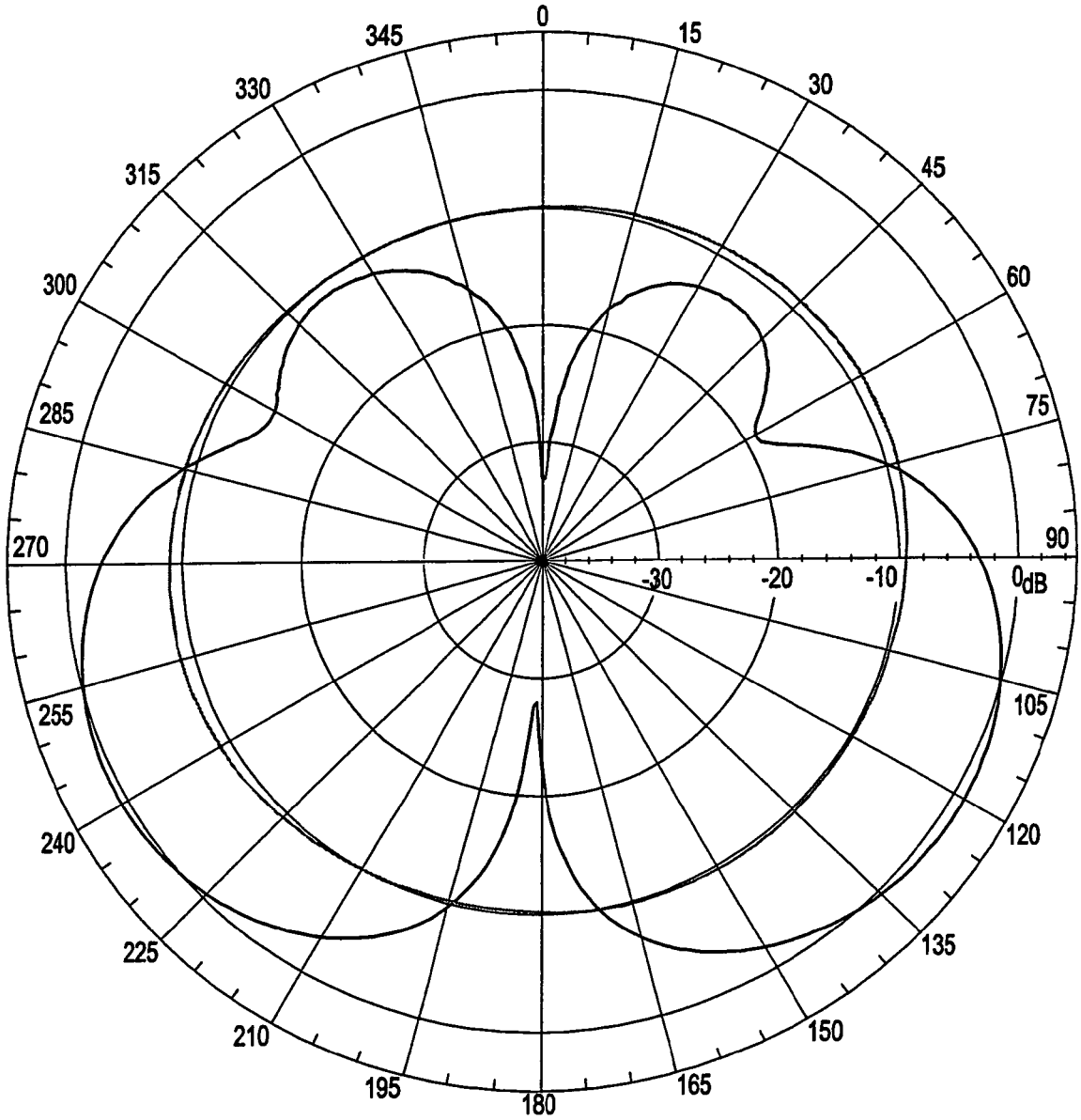
FIG. 10 is an illustrative view of the actual measured radiation pattern along the X-Y plane of the planar coordinates as depicted in FIG. 9.
Figure 11:
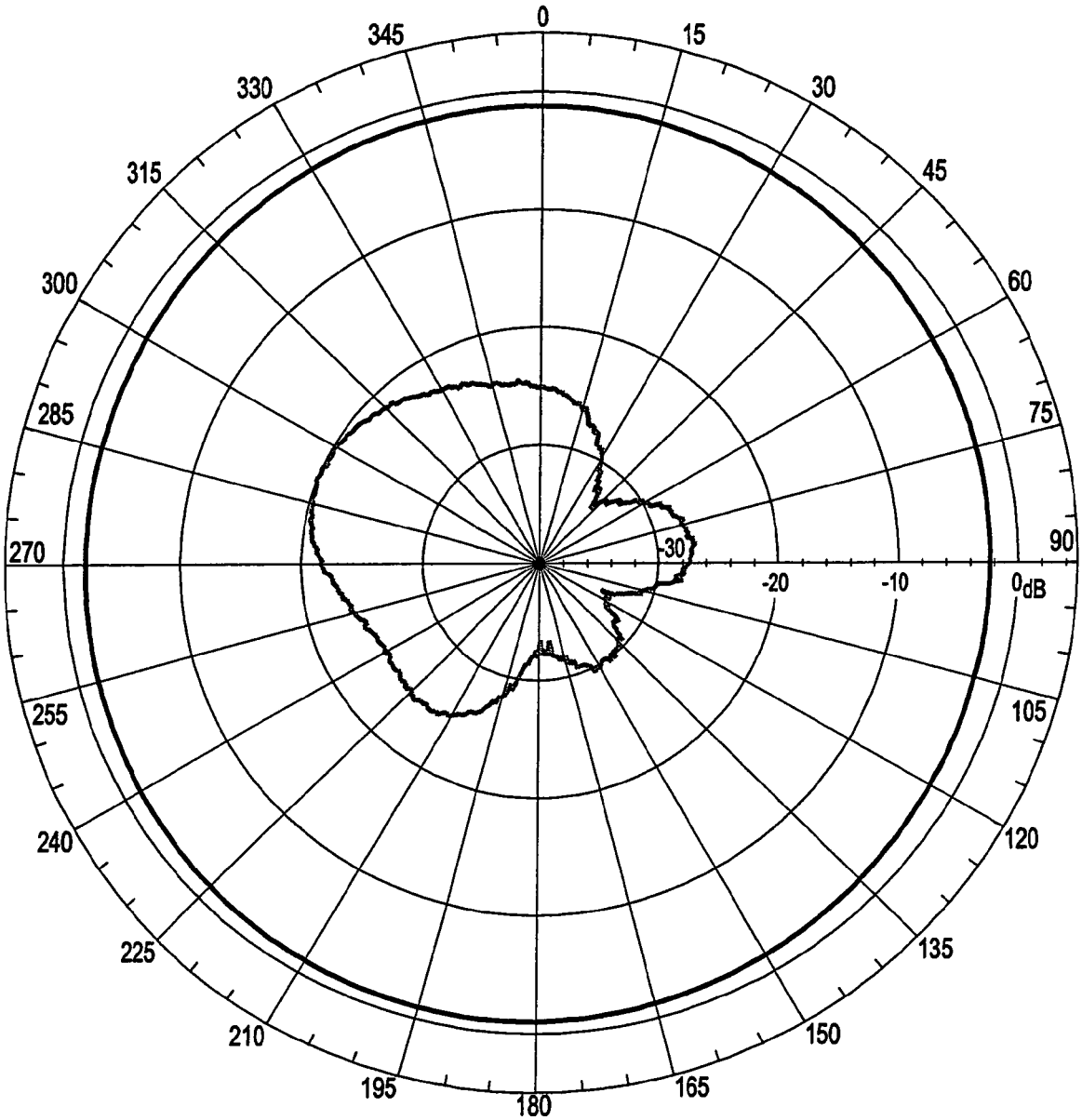
FIG. 11 is an illustrative view of the actual measured radiation pattern along the X-Z plane of the planar coordinates as depicted in FIG. 9.
Figure 12:
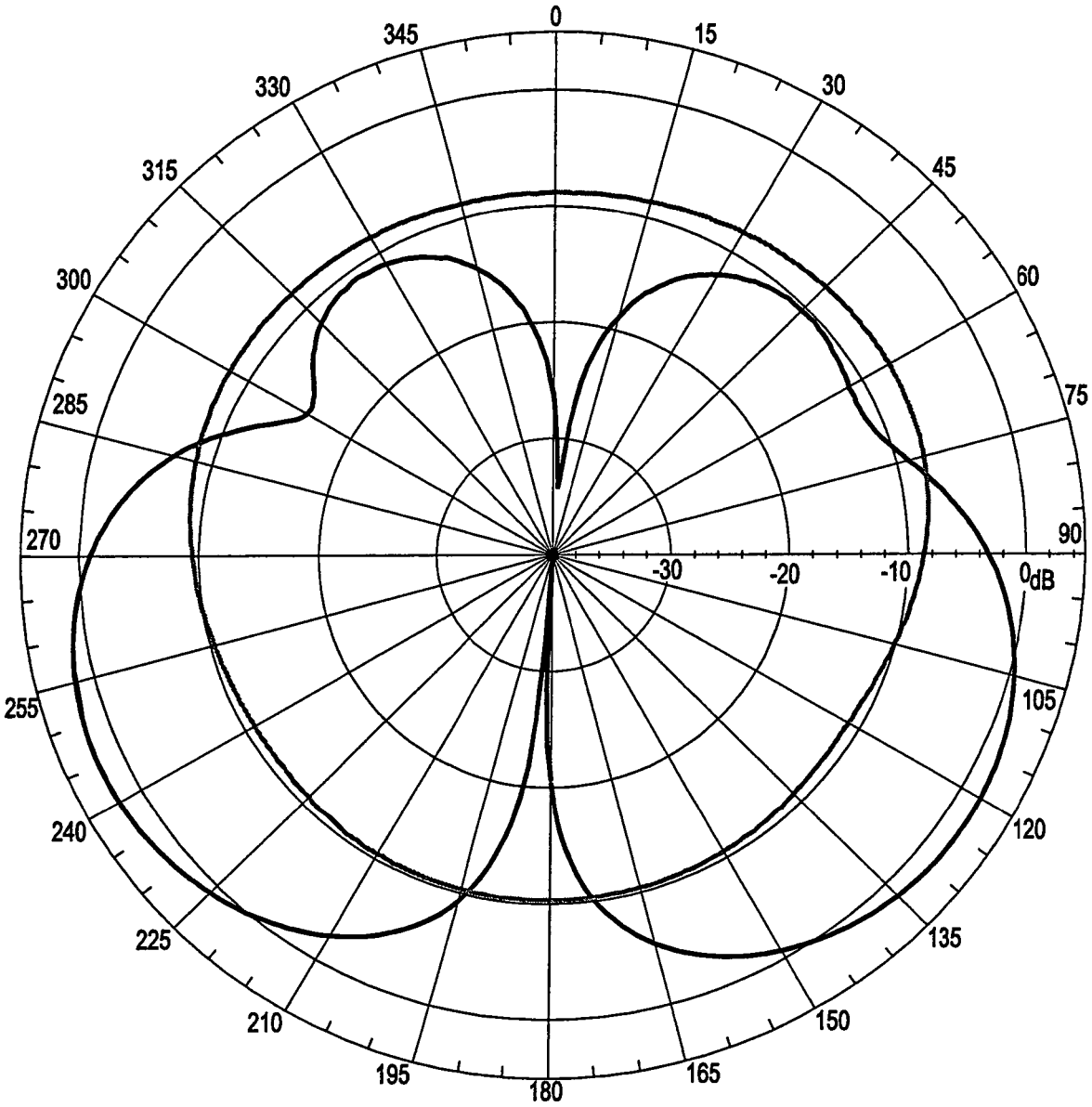
FIG. 12 is an illustrative view of the actual measured radiation pattern along the Y-Z plane of the planar coordinates as depicted in FIG. 9.

In the actual practice of the present invention, the antenna structure according to FIG. 6 comprises an antenna unit 62 disposed at a position approximately 2 mm from two symmetric ends 632 of the T-shape microstrip circuit 63 on the printed circuit board 61. Each antenna unit 62 comprises a meandering microstrip 621, and the width of the microstrip 621 is approximately 0.32 mm, and the meandering path is in the opposite direction of the symmetric end 631 and then bent 90 degrees towards the grounding metal surface after being extended to a length of approximately 4.5 mm, and is then bent 90 degrees backward after being extended to a predetermined length. An inverted S-shape meandering path is meandered between the microstrips 621*m* and a gap having a width of approximately 0.32 mm is maintained between adjacent microstrips 621. Therefore, after the microstrip 621 is meandered to a sufficient equivalent length, at least one external edge of the meandering microstrip 621 formed at the edge of the microstrip 621 continues to extend to the broadband plane 622 with a width of approximately 5.3 mm in order to increase the bandwidth of each antenna unit 62. In the embodiment, the edge of the broadband plane 622 keeps a distance of approximately 1 mm from the edge of the grounding metal surface 64 on one side. However, in other embodiments, the designer can easily fine tune the resonant frequency position of each antenna unit 62 by adjusting the distance between the broadband plane 622 and the grounding metal surface 64 as to adjust the antenna unit to the required bandwidth. Therefore, if the antenna array 60 is operated at the frequency band of 2.45 GHz specified by the IEEE 802.11b communication protocol, the characteristics of the antenna array 60 can be obtained by the reflection coefficient as shown in FIG. 8 after being tested by experiments. The center frequency is approximately 2.45 GHz; the usable bandwidth substantially covers the range of 2.35 GHz~2.53 GHz; and the bandwidth approaches 200 MHz. A planar coordinates of an antenna array 70 on one side of the wireless network card with a USB interface as shown in FIG. 9 is designed as a basis for measuring the radiation pattern. In the actual testing of the antenna array 70, the X-Y plane radiation pattern, X-Z plane radiation pattern and Y-Z plane radiation pattern as shown in FIGS. 10, 11 and 12 respectively can be measured. The radiation pattern of the invention not only has an excellent symmetric effect, but its radiating direction also shifts to both symmetric sides without concentrating at the central position, and thus effectively extending the range of the use on both symmetric edges.

While the invention has been described by means of specific embodiments, numerous modifications and variations could be made thereto by those skilled in the art without departing from the scope and spirit of the invention set forth in the claims.

What is claimed is:

1. An antenna array of printed circuit board, said antenna array comprising:

a printed circuit board, having a T-shape microstrip circuit disposed thereon, and an asymmetric end of said T-shape microstrip circuit serving as a feeding end of said antenna array;

two antenna units, being in a microstrip form and fabricated on one side of said printed circuit board, and said antenna units each comprising a meandering microstrip and a extended area planar section, wherein one end of each said meandering microstrip is respectively coupled to two symmetric ends of said T-shape microstrip circuit, each said meandering microstrip is symmetrically disposed on both corners adjacent to said printed circuit board, and each said extended area planar section is a plane extended from the other end of said meandering microstrip and being placed adjacent to an external edge of said meandering microstrip in at least one direction to a position adjacent to a corresponding edge of a grounding metal surface or edge of said printed circuit board; and wherein said grounding metal surface, is fabricated on the other side of said printed circuit and disposed at a position other than those corresponding to said antenna units and maintaining a specific distance from the external edge of each said extended area planar section.

2. The antenna array of printed circuit board of claim 1, wherein each said meandering microstrip has a meandering path along the direction opposite to said symmetric end and is bent 90 degrees towards said grounding metal surface after being extended to a predetermined length, and then bent 90 degrees backward to continue extending an inverted S-shape meandering path among said microstrips and maintain a predetermined width between the gaps of said microstrips.

3. The antenna array of printed circuit board of claim 1, wherein said grounding metal surface keeps a specific distance from the edge of said extended area planar section such that the bandwidth of said antenna array substantially covers the range from 2.3 GHZ to 2.53 GHZ, and the center frequency is substantially 2.45 GHz.

4. The antenna array of printed circuit board of claim 1, wherein said T-shape microstrip circuit is coupled to a capacitor in series at said asymmetric end of said T-shape microstrip circuit.

5. The antenna array of printed circuit board of claim 4, wherein said printed circuit board is a mini circuit board of a wireless network card with a USB interface.

* * * * *